United States Patent [19]

Machida

[11] 4,191,024

[45] Mar. 4, 1980

[54] DEFROSTING METHOD AND COOLING APPARATUS IN A REFRIGERATION SYSTEM

[76] Inventor: Keisuke Machida, 123, Oaza Hagishima Oyama City, Tochige Pref., Japan

[21] Appl. No.: 901,260

[22] Filed: Apr. 28, 1978

[51] Int. Cl.[2] ..... F25D 21/00; F25D 21/06; F25D 19/00; F25D 17/04

[52] U.S. Cl. ..... 62/80; 62/155; 62/299; 62/448; 62/515

[58] Field of Search ..... 62/80, 81, 155, 272, 62/299, 283, 383, 448, 449, 450, 515, 262, 282, 499

[56] References Cited

U.S. PATENT DOCUMENTS

| | | | |
|---|---|---|---|
| 2,559,217 | 7/1951 | Kehoe | 62/238 B |
| 2,729,072 | 1/1956 | Dybrig | 62/325 |
| 2,788,644 | 4/1957 | Gustafsson | 62/325 |
| 3,896,635 | 7/1975 | Stewart | 62/499 |
| 4,022,032 | 5/1977 | Nott | 62/263 |

FOREIGN PATENT DOCUMENTS

| | | | |
|---|---|---|---|
| 616325 | 7/1935 | Fed. Rep. of Germany | 62/499 |

*Primary Examiner*—Lloyd L. King
*Attorney, Agent, or Firm*—Wenderoth, Lind & Ponack

[57] ABSTRACT

For use in a refrigeration system, at least two coolers are provided symmetrically on opposite sides of a rotatable thermal shield plate separating the compartment to be refrigerated from the area outside the compartment. Defrosting method comprises alternately placing two coolers inside and outside the compartment at regular intervals in such a manner that one cooler placed inside is actuated for entering the refrigeration cycle while the other placed outside is disactuated out of the refrigeration cycle for having the accumulated frost or ice removed by melting in a higher temperature atmosphere. The alternate cooling and defrosting operations for each of the coolers are continuously repeated so that the compartment to be refrigerated can always be maintained at appropriate cooling temperatures. Cooling apparatus comprises a thermal shield plate turnably provided in an opening in one of the surrounding side walls, at least two symmetrical coolers on opposite sides of the shield plate each having an evaporator, an electromagnet valve in the evaporator for opening and closing the path or flow of a refrigerant liquid, and covering means on opposite sides of the aforesaid one side wall for hermetically enclosing the opening in the wall and having a water discharge outlet. The evaporators form a closed circuit by interconnecting each other, and the circuit has a port from which a refrigerant liquid is introduced and a port from which a vapor is discharged. The electromagnet valves are alternately operated so that the valve for the evaporator inside can allow a refrigerant liquid to flow thereinto and a vapor to flow out while the valve for the evaporator outside is closed.

7 Claims, 4 Drawing Figures

DEFROSTING METHOD AND COOLING APPARATUS IN A REFRIGERATION SYSTEM

BACKGROUND OF THE INVENTION

1. Field of the Invention

The present invention relates generally to defrosting method and cooling apparatus in a refrigeration system, and more particularly it is directed to removing frost or ice accumulated on the cooling apparatus by the alternate operations of the cooling apparatus.

2. Description of the Prior Art

With conventional refrigeration systems, it is the practice that refrigeration takes place by cooling the space or air in the compartment to be refrigerated. It is known that the continued cooling process causes moisture or water in the air to turn into frost or ice which accumulates on the evaporator tube, expansion valves and other associated cooling parts, thus lowering the thermal efficiency followed by a decreased functional performance of the cooling mechanism. The frost accumulation takes place the more vigorously if the lower temperature is desired, and because of this the performance of the cooler very often drops to one half or one third of its normal performance. Behind these backgrounds, there are various methods of and constructions for removing frost or ice from the cooler. According to any of the prior methods and constructions, the practice is that frost or ice on the evaporator, for example, is removed by raising the temperature in the surroundings in which the evaporator is mounted. This necessitates a temporary stop of the refrigeration cycle, followed by a temporary thermal dissipation which results in a rise in the temperature inside the enclosure. This causes a lower total thermal efficiency. Possible defrosting methods may conceivably include interrupting the refrigeration cycle, warm water feeding, electric heating, gas heating, introducing air into the compartment, etc. All methods mentioned above may vary in time required for defrosting, but the calorie required depends upon the amount of frost invariably with all those methods. For this reason, the refrigeration cycle must be stopped temporarily while the defrosting cycle takes place, thus raising the temperature in the cooler followed by a rise in the temperature in the compartment. As noted from the above, there is so far no improved defrosting means that can solve the outstanding problems.

SUMMARY OF THE INVENTION

Having the problems to be solved in consideration, it is one object of the present invention to provide improved defrosting method and cooling apparatus, in which two symmetrical coolers are provided to permit alternate cooling and defrosting operations thereof. More specifically, when one cooler is placed inside the compartment and is operated for the refrigeration cycle, the other cooler is placed outside whose cooling operation is stopped for having frost or ice removed from the cooler. Therefore, both defrosting and cooling operations can be performed simultaneously. In other words, the defrosting process is carried out without raising the temperature inside or stopping the refrigeration cycle. In this case, it may be thought that there is a thermal loss in a transition from the normal to cooling temperatures when the cooler outside is again placed inside, but such thermal loss can be avoided by commencing the refrigeration cycle for that cooler a little before it has been positioned inside.

BRIEF DESCRIPTION OF THE DRAWINGS

Other objects and advantages of the invention will become apparent from the detailed description of the preferred embodiments which is made hereinafter by reference to the accompanying drawings, in which.

DESCRIPTION OF THE PREFERRED EMBODIMENTS

Figure 1:
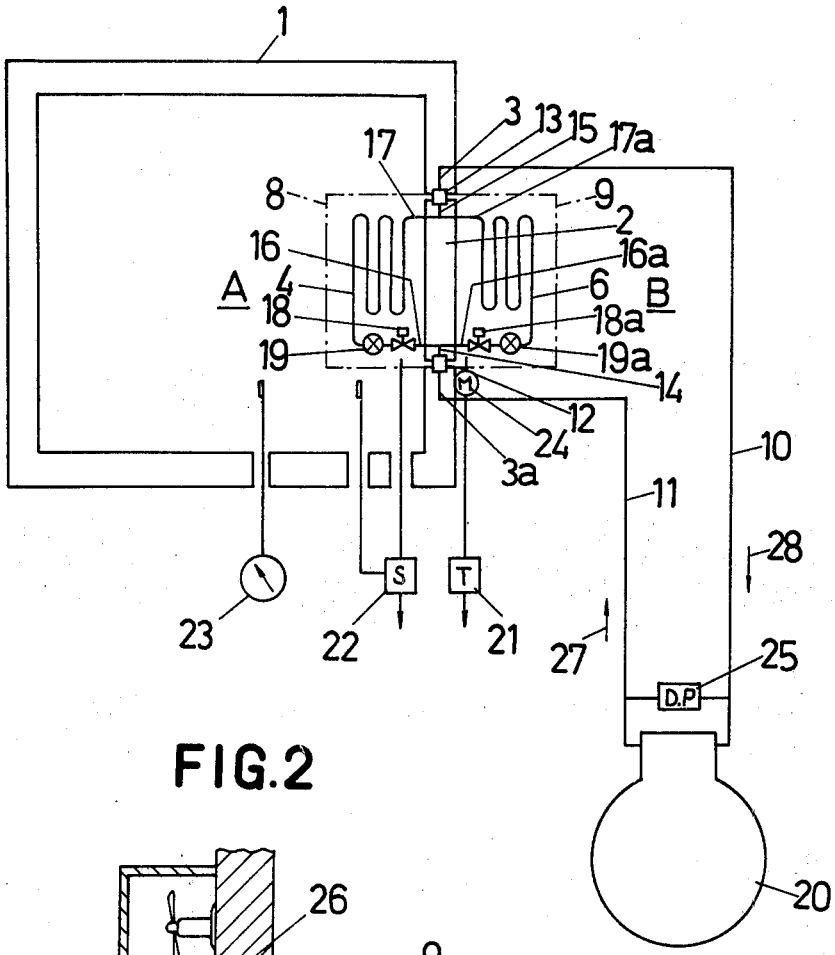
FIG. 1 is a diagram illustrating the principle of operation according to the invention.
Figure 2:
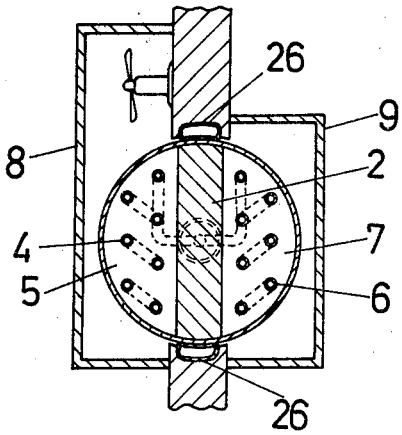
FIG. 2 is a cross-sectional plan view of the location in which the evaporators are mounted.
Figure 3:
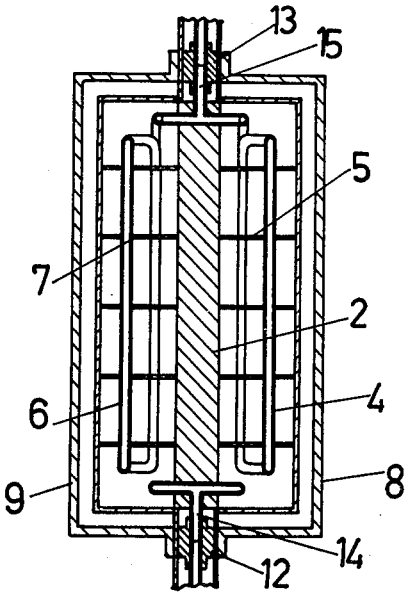
FIG. 3 is a longitudinal cross-sectional side view of FIG. 2.
Figure 4:
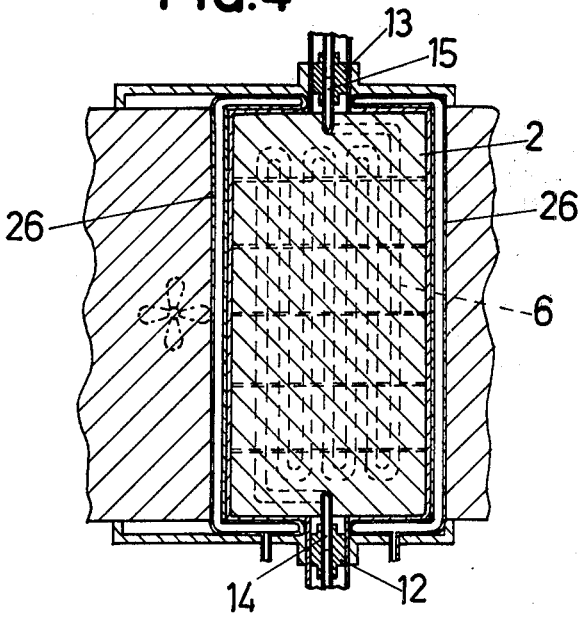
FIG. 4 is a longitudinal cross-sectional elevation view of FIG. 2.

A preferred embodiment of the invention will be illustrated in greater detail by referring to the drawings. A thermally insulated enclosure 1 has one side wall provided with an opening at the upper portion thereof. Mounted in the opening is a thermally insulating plate 2 which is rotatably supported by vertical shafts 3, 3*a* as the upper and lower sides thereof. As particularly shown in FIG. 4, the insulating plate 2 has a similar shape to the opening for covering the latter in its closed position. On one side of the insulating plate 2, or on the inner side of the enclosure 1 in FIGS. 1 and 3, is mounted an evaporator A which consists of an evaporator tube 4 and heat exchanger plates 5, while on the opposite side, or outside, is mounted an evaporator B consisting of an evaporator tube 6 and heat exchanger plates 7. Inside cover 8 and outside cover 9 are fixed to the side wall of the enclosure 1 for enclosing the evaporators A and B. The vertical shafts 3, 3*a* have a hollow tubular form, one shaft 3 being connected to one end of a low pressure pipe 10 and the other shaft 3*a* being connected to one end of a high pressure pipe 11. More particularly, the shaft 3 is connected by way of a rotatable coupler 13 to a vapor outlet pipe 15, and the shaft 3*a* is connected by way of a rotatable coupler 12 to a refrigerant liquid inlet pipe 14. Branch pipes 16 and 16*a* extend from the inlet pipe 14, and branch pipes 17 and 17*a* extend from the vapor outlet pipe 15. Branch pipes 16 and 16*a* are connected with corresponding evaporator tubes 4 and 6 by way of electromagnet valves 18 and 18*a* and further expansion valves 19 and 19*a*, the evaporator tubes 4 and 6 winding to be connected with the corresponding branch pipes 17 and 17*a*. The high pressure pipe 11 and the low pressure pipe 10 extend to the outlet and suction sides of a compressor-condenser means 20, respectively. In this way, a refrigerant liquid circulating passage is completed as shown in FIG. 1. In the drawings, reference numeral 21 designates a timer which is previously set to actuate a motor 24 which is an upright-shaft motor. A thermostat switch 22 is responsive to changes in the temperature inside the enclosure 1 for actuating the electromagnet valve 18. A thermometer 23 outside the enclosure indicates the temperature inside. Reference numeral 25 denotes a pressure actuated switch whose operation will be described when the operation of the apparatus is explained. A hollow packing 26 is fitted inside the peripheral recess of the opening in the wall, and if necessary, may be pneumatically inflated so as to keep airtight inside the enclosure. In the latter case, the air is automatically removed from the packing 26 at the time when the shield plate 2 turns around so as to facilitate its rotation without frictional resistance.

The operation of the apparatus described above is now explained below. For the convenience of explanation and ease of comprehension, suppose that the cooling operation is now at rest after completion of one refrigeration cycle and the coolers A and B are positioned as indicated in FIG. 1, and therefore there is a rise in the temperature inside the enclosure 1 above the previously set temperature value. Then, the thermostat switch 22 responds to the temperature rise to acuate the electromagnet valve 18 to open so that it can allow a liquid refrigerant to be fed from the high pressure pipe 11 in the direction of an arrow 27, passing through the expansion valve 19 to the evaporator tube 4 in which the refrigerant evaporates to a vapor state. The vapor then passes through the outlet pipe 15 and shaft 3 into the low pressure pipe 10, going into the compressor-condenser means 20 as indicated by an arrow 28 where the vapor is compressed and condensed to a liquid refrigerant. The above described operation is repeated through the entire refrigeration cycle to lower the temperature inside the enclosure 1. With the inside temperature below the set temperature, the thermostat switch 22 responds to it and is then turned off, closing the electromagnet valve so that the liquid refrigerant is cut off. Thus, the cooling cycle is interrupted and the cooling operation is ceased. In this case, the part of the liquid which remains in the cooling passage is withdrawn toward the compressor-condenser means 20 and is collected into a receiving tank (not shown), causing the suction pipe so to be placed under a lower pressure, which then actuates the pressure-actuated switch 25 to turn off its low pressure side, so that the compressor of the compressor-condenser means turns off. At the end of a certain time period (24 hours, for example) preset to the timer 21, the timer 21 gives out a signal which energizes the motor 24 to turn the shield plate 2 through 180 degrees. At this time, the evaporators A and B have changed their positions, i.e., the evaporator A is placed outside and the evaporator B is placed inside. For the evaporators A and B to change their positions, there are four possible situations, as follows:

Instance (1) in which the thermostat switch is operating, opening the electromagnet valve so that the refrigeration cycle takes place: In this instance, as the evaporators A and B have changed their positions, the electromagnet valve 18 for the evaporator A is closed while the electromagnet valve **18*a* for the evaporator B is opened, allowing the liquid refrigerant to be introduced into the evaporator tube 17*a* but not into the evaporator tube 17. Thus, the evaporator B enters the refrigeration cycle without discontinuance. In order to follow the above operation, there are several constructional possibilities. To show one example, the circuit in which the electromagnet valves are operated in response to the thermostat switch may be constructed such that the electromagnet 18 or 18*a* is electrically actuated only when it is placed in its operating position inside, and during the rotation of the evaporators to their alternate positions, both valves remain closed for a temporary time period and when either valve 18 or 18*a* is placed in its inside operating position, it is then actuated to allow the liquid refrigerant to be introduced into the corresponding evaporator tube. If the refrigeration cycle for one evaporator is ceased for a moment as described earlier, the remaining part of refrigerant is then withdrawn toward the compressor-condenser means 20** and collected into the receiving tank. As the discontinued interval is very short such as for example less than one minute, a next refrigeration cycle for the other evaporator is commenced again while the remaining coolant is being withdrawn into the compressor-condenser means. Therefore, there is no possibility or risk of inviting the pressure switch to stop the compressor, and the refrigeration cycles proceed without discontinuance.

Instance (2) in which the thermostat switch turns on while the evaporators are changing their positions: As the evaporator A is going outside with the evaporator B going inside, the electromagnet valve **18*a* for the evaporator B, on reaching its operating position, is actuated to allow the liquid refrigerant to be introduced into the evaporator tube. The vapor produced in the tube flows through the vapor outlet pipe 15 into the low pressure pipe 10, raising the pressure in the suction side of the compressor-condenser means 20** to actuate the pressure-actuated switch to turn on its low side switch so that the compressor is again operated. Thus, the refrigeration cycles follows one after another.

Instance (3) in which the thermostat switch turns off while the evaporators A and B are changing their positions: As the shield plate 2 begins to rotate, moving the evaporator A outside while moving the evaporator B inside, the electromagnet valve 18 is deenergized for being closed and cuts off the refrigerant. The portion of the refrigerant remaining in the evaporator A is withdrawn by suction toward the compressor-condenser means and is collected into the receiving tank. On the other hand, the electromagnet valve **18*a*** for the evaporator B is not electrically actuated even if it is placed in its operating position, so that it is held in its closed position. Thus, the remaining refrigerant continues to be introduced into the compressor-condenser means and in its condensed state back to the tank. As almost all remaining refrigerant has been collected into the tank, the pressure switch is then operated so that its low side circuit is opened, stopping the compressor.

Instance (4) in which the thermostat switch remains to be off during the changing positions: As both electromagnet valves are closed, the part of the refrigerant remaining in the evaporator A is withdrawn toward the compressor-condenser means and in its condensed state back onto the receiving tank. With a lower pressure on the suction side of the compressor-condenser means, the pressure switch is turned off, stopping the compressor. Even if the evaporators have changed their positions in the above situation, the compressor remains to be stopped as long as the temperature inside is maintained below the preset temperature value. However, if there is a rise in the inside temperature to which the thermostat switch responds for actuating the electromagnet valve **18*a*** to open, the liquid refrigerant is then introduced into the evaporator B, and the vapor produced in the evaporator tube flows out into the suction side of the compressor-condenser means, raising the pressure in the suction pipe to allow the low side of the pressure switch to turn on. Thus, the compressor is again energized. At this moment, a refrigeration cycle is entered.

In accordance with the invention, there are at least two evaporators which are alternately placed inside and outside the enclosure. While one evaporator is placed inside and is operating, the other evaporator is placed outside and is having its accumulated frost or ice removed in the higher temperature atmosphere or by heating. It will be readily understood from the above that cooling and defrosting operations are so concurrent that the defrosting operation can be done without having to stop the cooling operation. Heat required to remove frost or ice from the coolers is obtained from the atmosphere outside the enclosure, or if necessary, from an external heater which is provided outside the enclosure. As the compartment to be refrigerated is thermally isolated from the heating location inside the cover by means of the thermal shield plate, there cannot take place a heat flow into the compartment, resulting in maintaining the compartment in a cold air. As the defrosting operation is allowed for a sufficient time on one hand and yet this does not involve stopping the cooling operation on the other hand, it is advantageously possible to melt and remove completely frost or ice that has been accumulated on the evaporator tubes including wound end portions, and expansion valves. As the defrosting operation takes place at properly selected intervals and properly, the thermal efficiency can advantageously be maintained to a satisfactory level, and the refrigeration system can be kept operating with the maximum efficiency. Increased capabilities of the cooling apparatus reduce the size of the evaporators, which results in offsetting incremental costs caused by installing two or more evaporators. The two electromagnet valves have been shown, one for each evaporator, but alternatively, if a three-way cock is disposed at the entry of the branch pipes and is operated to selectively connect to one or the other evaporator tube, a single electromagnet valve in place of two can also serve the purpose described above.

The apparatus according to the invention can find uses in the natural flow type or forced flow type refrigeration system. In the case of its usage in the forced flow type system, it is desirable that a fan be stopped for a moment when the evaporators are changing their positions in order to prevent outside air from being introduced into the compartment and cool air from flowing out.

Although the invention has been illustrated by way of examples, it should be understood that various changes and modifications may be made without departing from the spirit and scope of the invention.

What I claim is:

1. In a refrigeration system for preserving foods and others in an enclosure, a method of removing frost or ice accumulated during the refrigeration cycle on cooling means which are symmetrically provided on the opposite sides of a thermally shielding plate rotatably mounted in an opening in one side wall of the enclosure, the method comprising the steps of:

operating the thermally shielding plate at regular intervals for alternately placing cooling means inside and outside the enclosure such that one cooling means is placed inside the enclosure while the other is placed outside; and actuating only the cooling means inside the enclosure to commence its refrigeration cycle for cooling the air inside, and deactuating the cooling means outside during the refrigeration cycle of the first-mentioned cooling means for being subjected to externally applied higher temperature and having the accumulated frost or ice removed by melting.

2. A method as defined in claim 1, wherein the refrigeration cycle and the defrosting cycle are performed simultaneously and alternately for the cooling means, thereby permitting uninterrupted refrigeration cycles within the enclosure.

3. In a refrigeration system, cooling apparatus of the type having evaporator, expansion valve and compressor-condenser means wherein the improvement comprises:

a refrigeration enclosure surrounded by four side walls, at least one wall having an opening therein;

a thermal shield plate normally hermetically mounted within said opening for rotation through 180 degrees at regular intervals on vertical hollow shafts supporting the upper and lower sides thereof;

symmetrical evaporator means on the opposite sides of said thermal shield plate interconnected for forming a closed circuit, said circuit having an inlet for introducing a liquid refrigerant from the compressor into the circuit and having an outlet for allowing a vapor to flow from the circuit into the compressor;

electromagnetic valve means disposed in the circuit for being selectively actuated for introducing the liquid refrigerant into the evaporator means only when it is placed inside the enclosure;

presettable timer means for energizing a motor at regular intervals for rotating said thermal shield plate through every angle of 180 degrees thermostatic switch means responsive to a change in temperature inside the enclosure below a certain value for disactuating said electromagnetic valve means to close;

pressure-actuated switch means responsive to a change in suction pressure for controlling the operation of the compressor; and covering means for enclosing said evaporator means on the opposite sides of said one wall, each having a water outlet therein.

4. Cooling apparatus as defined in claim 3, wherein said covering means includes heating means operated when the corresponding evaporator means is placed outside the enclosure.

5. Cooling apparatus as defined in claim 4, wherein said heating means is an electrical heater.

6. Cooling apparatus as defined in claim 3, wherein said electromagnetic valve means is disposed in each of said evaporator means.

7. Cooling apparatus as defined in claim 3, wherein said electromagnetic valve means is disposed at the inlet of the closed evaporator circuit, and a three-way cock is disposed downstream of said electromagnetic valve means whereby the three-way cock is operated for selectively introducing the liquid refrigerant into the evaporator means when it is placed inside the enclosure.

* * * * *